United States Patent [19]

Luke

[11] Patent Number: 4,872,300

[45] Date of Patent: Oct. 10, 1989

[54] CAP DETECTOR FOR BOTTLING SYSTEM WITH HIGH SPEED GATE MECHANISM

[75] Inventor: James J. Luke, Bloomsburg, Pa.

[73] Assignee: Frankandale Corporation, Berwyn, Ill.

[21] Appl. No.: 237,300

[22] Filed: Aug. 26, 1988

[51] Int. Cl.[4] ..... B65B 7/28; B67B 3/26

[52] U.S. Cl. ..... 53/53; 53/72; 53/506

[58] Field of Search ..... 53/53, 506, 72, 505, 53/316, 315, 314, 313, 282, 281, 67, 64, 75

[56] References Cited

U.S. PATENT DOCUMENTS

| | | | |
|---|---|---|---|
| 3,460,314 | 8/1969 | Keas | 53/72 |
| 3,477,197 | 11/1969 | Budz | 53/53 |
| 4,312,172 | 1/1982 | Fisher | 53/72 X |
| 4,773,204 | 9/1988 | Rydstrom | 53/506 |

*Primary Examiner*—James F. Coan

*Attorney, Agent, or Firm*—Beverly A. Vandenburgh

[57] ABSTRACT

A device having a cocked cap detector and a missing cap detector in a bottle production line is disclosed. The device also includes a gate diverter mechanism for diverting miscapped bottles from their narrower top portion.

8 Claims, 3 Drawing Sheets

CAP DETECTOR FOR BOTTLING SYSTEM WITH HIGH SPEED GATE MECHANISM

The present invention is directed to a cap detector for a bottling system and, more particularly, to an in-line cap detector that detects cocked caps, missing caps or caps without foil seals in a bottling production line having a high speed gate mechanism that redirects the bottle from the narrower top portion, thus permitting faster speed.

BACKGROUND OF THE INVENTION

A miscapped, leaking bottle in a bottling production line, if undetected, potentially causes a great deal more damage than the loss of one bottle of product. It slows production and requires additional labor to clean up the spill. Further, the spilled product can damage cardboard cartons or palletized units, thus causing the loss of additional units. The danger becomes even more serious if hazardous materials are contained in the bottle.

In most capping operations, machine operators attempt to identify miscapped bottles merely by sight. Due to repetitious work and fatigue, improperly capped bottles are often missed. One attempt to solve this problem has been to provide automatic cap detectors, such as the Fail-Safe TM FSD 8700 detector and the Missing Cap-High Cap Detection Fail Safe TM, both manufactured by Culbro Corporation of Kingston, Pa.

These prior systems detect a missing band from around the cap of the bottle. Fiber optic sensors detect the presence of a bottle at the sensing station and UV sensors detect the presence or absence of an ultraviolet treated shrink band or graphic sleeve material around the bottle cap. The bottles are transported through the detector system on a conventional conveyor belt. Bottles that are missing bands are removed through an ejection unit, which utilizes an air cylinder mechanism to redirect the bottles.

One difficulty with the above detectors is that the fiber optic sensors are easily damaged or rendered inoperable due to a build-up of dirt and the like. Further, because the ejection unit redirects the bottles from the wider lower portion of the bottle, the air cylinder operates through along stroke. Thus, the system slows while the failed bottle is removed. An additional difficulty arises because the product is pushed off the line at a 90 degree angle. Thus, a high percentage of product is unrecoverable, resulting in serious product loss.

SUMMARY OF THE PRESENT INVENTION

The present invention overcomes the above disadvantages by providing an in-line cap detector having a high speed gate feature for removing bottles that have been detected as improperly capped. The gate mechanism of the present invention directs the bottles off of the conveyor line by redirecting bottles from the narrower top portion of the bottles. Thus, a shorter stroke is required, resulting in a more efficient system.

The present invention has the additional advantage that bottles are diverted at an angle of less than 90 degrees, which avoids high impact and offers a greater potential for recovery of product. The present invention also has the further advantage that the electrical controls are placed above the bottle conveyor. In this way, the electrical components are not damaged by leaking bottles or lubrication from the conveyor system, nor is there likely to be collision damage (from colliding with, for example, fork lifts, carts, or the like). In addition, the present invention is not limited by the chosen capping method. Both push-on and screw-on type caps can be checked.

BRIEF DESCRIPTION OF THE DRAWINGS

The features of the present invention can be better understood through reference to the following drawings, in which.

DETAILED DESCRIPTION OF THE PREFERRED EMBODIMENTS

Figure 1:
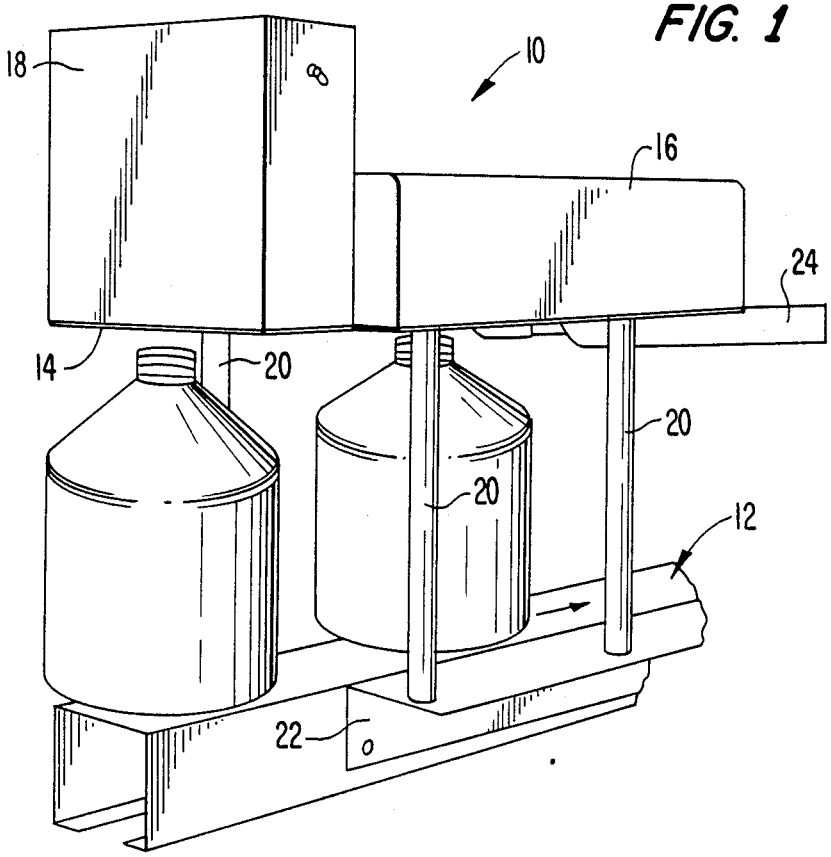
FIG. 1 is an overall perspective view of the cap detector for a bottling system in accordance with a preferred embodiment of the present invention.

A preferred embodiment of the in-line cap detector device for a bottling system in accordance with the present invention is shown in FIG. 1 and generally designated as 10. Throughout the figures, like numerals will be used to designate like elements.

Figure 2:
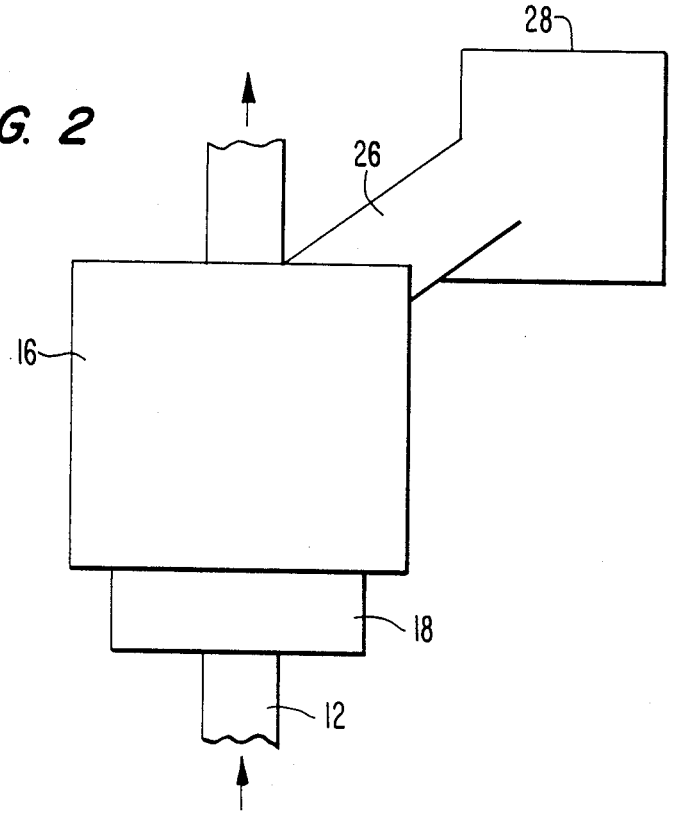
FIG. 2 is a top view of the system shown in FIG. 1.

Device 10 includes a conveyor 12. Conveyor 12 transports the containers through the detector device. Device 10 further includes base plate 14 with main housing cover 16 and controls housing cover 18. Suitable supports, such as columns 20 mounted on support bracket 22, support the base plate above the conveyor. In this way, the components cannot be damaged due to leaking containers. Gate diverter arm 24, attached in a manner to be discussed in more detail below, diverts improperly capped bottles down inclined conveyor 26 to miscapped bottle storage container 28, as can be seen in FIG. 2.

Figure 3:
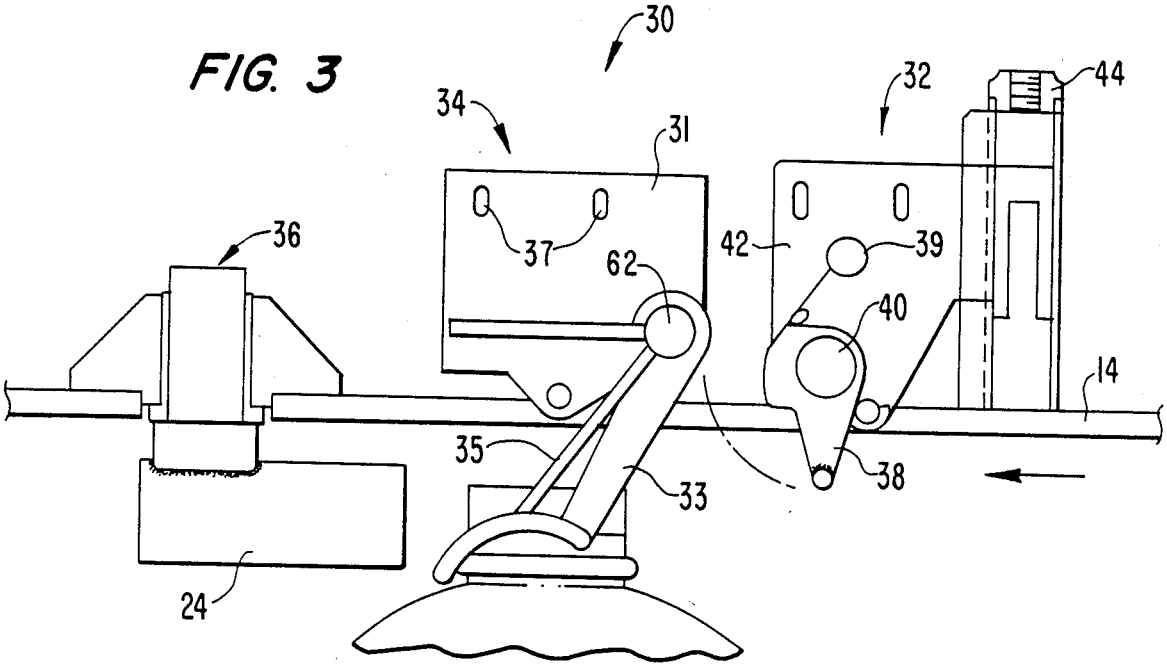
FIG. 3 is a side elevational view of the cap detection mechanisms of the system shown in FIG. 1.
Figure 4:
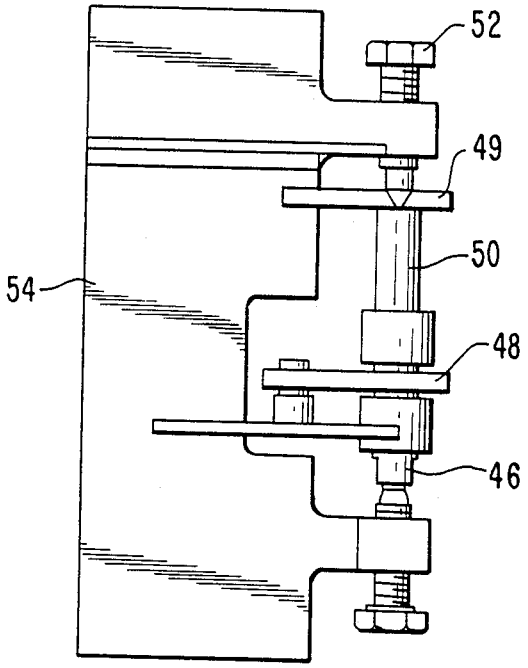
FIG. 4 is a top view of the cap/no-cap detector shown in FIG. 3.
Figure 5:
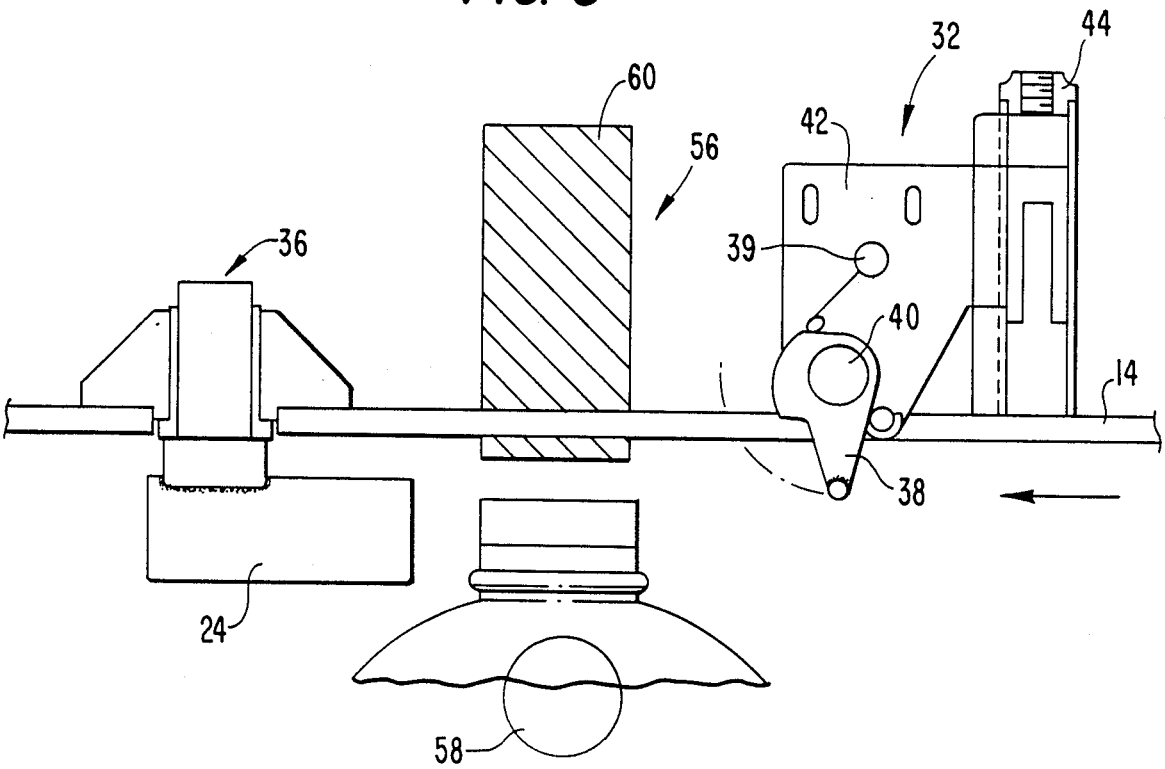
FIG. 5 is a side elevational view of the cap detection mechanism for use with foil caps, in accordance with another preferred embodiment of the present invention.

Detection unit 30 is clearly illustrated in FIGS. 3 and 4 and generally includes cocked cap detector 32, cap/-no-cap detector 34 and gate diverter unit 36. If foil caps are used, the mechanical levers of the cap/no-cap detector is replaced with proximity detector 56, as shown in FIG. 5 and discussed in more detail below.

Cocked cap detector 32 includes mounting plate 42 mounted on bracket 44. Push lever 38 is pivotally mounted to the plate via pivot 40. Roller activated switch 39, such as a MICRO SWITCH TM made by Honeywell, is operatively coupled between push lever 38 and gate diverter 24. Of course, any suitable type of switch can be used.

In operation, bottles travel down conveyor 12 in the direction of the arrow. If the cap on a bottle is cocked, it will push lever 38 upwardly. This movement of the push lever will activate switch 39. The switch sends a signal activating the gate diverter, thereby diverting the bottle off of the production line and into container 28 for disposal.

As seen in FIGS. 3 and 4, cap/no-cap detector 34 includes levers 33 and 35 pivotally mounted via pivot 62 to mounting plate 31. Switches 37 are operatively coupled between the levers and the gate diverter. Switches 37 are also preferably MICRO SWITCHES TM, by Honeywell.

As seen in FIG. 4, mounting plate 54 supports pivot shafts 46 and 50. Coupled to these shafts are cam 48 and cam 49. Cam 48 triggers one of the switches 37 in response to lever 33. Cam 49 triggers the other switch 37 in response to lever 35. Bearing screws 52 can be used to adjust the pivots shafts.

After passing the cocked cap detector 32, the bottles continue travelling along conveyor 12 to the cap/no-cap detector. If a bottle has a cap on it, both lever 33 and lever 35 will be tripped. In this case, the signals "cancel each other out", and no signal is sent to the gate diverter. If a bottle is missing a cap, both levers will initially be tripped. However, as the bottle travels down the conveyor, lever 33 will drop because no cap is there to support it. Thus, the signals do not cancel and an activating signal is sent to the gate diverter, thereby diverting the bottle off of the production line, as in the case of a cocked cap.

If the bottles are capped with foil caps, proximity detector 56 is utilized, as shown in FIG. 5. Instead of the mechanical lever arms utilized in the cap/no-cap detector, the proximity detector 56 includes a proximity switch 60 and a beam switch 58. Proximity switch 60 may be of any suitable type, such as the capacitive model made by Efector, King of Prussia, Pa. Similarly, beam switch 58 may be of any suitable type, such as the diffuse-reflective model made by Automatic Timing & Controls Co., also of King of Prussia, Pa.

These switches are coupled to the gate diverter. If it is determined that the foil cap is missing, an activating signal is sent to the diverter, diverting the bottles off of the production line, in the manner discussed above.

As can be seen particularly in FIGS. 3 and 5, gate diverter unit 36 has a diverter arm 24. This arm contacts the bottles substantially at the bottle's narrowest point. In this way, a shorter diverter arm stroke is required, resulting in a more efficient operation The foregoing is for illustrative purposes only. Changes can be made, particularly with regard to matters of size, shape and arrangement of parts, within the scope of the invention as defined by the appended claims.

I claim:

1. A cap detection device for detecting a missing or cocked cap of a container in a production line, said device comprising:

a frame;

a conveyor coupled to said frame for transporting the containers through said device;

first detection means disposed above said conveyor for determining if one of the containers on said conveyor has a cocked cap;

second detection means disposed above said conveyor for determining if one of the containers on said conveyor has no cap; and gate means for redirecting a container with a cocked cap or no cap off of the production line.

2. A device as in claim 1, wherein said first detection means includes a pivoting push lever and a cocked cap switch operatively coupled between said push lever and said gate means, so that a cocked cap on a container will pivot said push lever, activating said cocked cap switch and causing said gate means to divert the container off the production line.

3. A device as in claim 1, wherein said second detection means includes a first and second lever arm.

4. A device as in claim S, wherein said first and second lever arms are pivotable, said second detection means further including first and second missing cap switches coupled between the corresponding one of said lever arms and said gate means, so that a properly capped container triggers both lever arms, thereby sending no signal to activate said gate means, and a container with no cap triggers both lever arms while allowing the first arm to drop, activating said first switch, thus causing said gate means to divert the container off of the production line.

5. A device as in claim 2, wherein said second detection means includes at least one beam detector for detecting the absence of a foil cap.

6. A device as in claim 1, wherein said gate means includes a grip portion for contacting the container along the top narrow portion of the container when diverting the container from the production line.

7. A device having a conveyor for moving containers along a production line, said conveyor travelling below a missing container cap detector including at least two mechanical levers and a cocked container cap detector having at least a push lever activated by a cocked cap, said device comprising:

a frame means for supporting the conveyor and the detectors;

a miscapped container disposal area;

a chute connecting said disposal area and the conveyor; and a gate means for redirecting a miscapped container onto said chute; said gate means having a grip portion for contacting the containers along the containers narrower top portion.

8. A missing cap detector device for detecting containers with missing caps travelling along a conveyor in a production line and diverting the miscapped containers off the production line via a gate mechanism, said device comprising:

a first pivotable lever arm disposed above the conveyor;

a first switch operatively coupled to said first lever arm;

a second pivotable lever arm disposed above the conveyor; and a second switch operatively coupled to said second lever arm; so that a properly capped container triggers both said first and said second lever arms, thus activating both said first and said second switches in a manner to generate two signals that negate one another, while a container with a missing cap initially triggers both said first and said second lever arms, with the first lever arm dropping back into place, so that only one signal is generated, activated the gate mechanism and diverting the container from the production line.

* * * * *